US007523874B2

(12) United States Patent
Kon et al.

(10) Patent No.: US 7,523,874 B2
(45) Date of Patent: Apr. 28, 2009

(54) ROTARY NOZZLE AND DETERGENT DISSOLVING SYSTEM USING THE SAME

(75) Inventors: Yukio Kon, Tokyo (JP); Kenichi Ono, Tokyo (JP)

(73) Assignee: Welco Co., Ltd., Tokyo (JP)

( * ) Notice: Subject to any disclaimer, the term of this patent is extended or adjusted under 35 U.S.C. 154(b) by 716 days.

(21) Appl. No.: 11/226,375

(22) Filed: Sep. 15, 2005

(65) Prior Publication Data

US 2006/0249183 A1 Nov. 9, 2006

(30) Foreign Application Priority Data

May 9, 2005 (JP) ..... 2005-136352

(51) Int. Cl.
*B05B 3/00* (2006.01)

(52) U.S. Cl. ..... 239/225.1; 239/251; 239/227; 239/242; 134/179; 134/198

(58) Field of Classification Search ..... 239/225.1, 239/251, 226, 227, 242, 228; 134/179, 176, 134/198

See application file for complete search history.

(56) References Cited

U.S. PATENT DOCUMENTS 2,734,520 A * 2/1956 Abresch et al. ..... 134/174
3,807,636 A * 4/1974 Fackler ..... 239/226
3,960,328 A * 6/1976 Archambault ..... 239/264
4,030,513 A * 6/1977 McKenzie ..... 134/167 R
4,421,275 A * 12/1983 Gratton ..... 239/226
4,704,071 A * 11/1987 McCullough ..... 417/85
5,131,419 A * 7/1992 Roberts ..... 134/50
5,330,102 A * 7/1994 Jarvis et al. ..... 239/228
5,488,965 A * 2/1996 Hori ..... 134/180
5,964,232 A * 10/1999 Chung ..... 134/176
6,666,220 B2 * 12/2003 Spanyer et al. ..... 134/58 D

FOREIGN PATENT DOCUMENTS

JP A 09-131295 5/1997
JP A 2005-046309 2/2005

* cited by examiner

*Primary Examiner*—Len Tran
*Assistant Examiner*—Trevor E McGraw
(74) *Attorney, Agent, or Firm*—Oliff & Berridge, PLC

(57) ABSTRACT

Dissolving a solid detergent packed in a detergent container while forming a dissolved surface into a horizontal surface without leaving any detergent in the container. Among these, a rotary nozzle within a closed structure, in which the rotary-nozzle fixture is mounted in a center of rotation of a rotary-nozzle body, the rotary-nozzle body is formed to be substantially S-Shaped in a plan view and divided vertically into two upper and lower parts, where the lower part of the rotary-nozzle body is provided with a rotating shaft hole, which is disposed centrally in a longitudinal direction, formed on a top thereof with a circular groove.

4 Claims, 12 Drawing Sheets

PRIOR ART

PRIOR ART

PRIOR ART

ROTARY NOZZLE AND DETERGENT DISSOLVING SYSTEM USING THE SAME

BACKGROUND OF THE INVENTION

1. Field of the Invention

The present invention relates to a rotary nozzle capable of dissolving a solid detergent packed in a detergent container, and a detergent dissolving system, in which the rotary nozzle is used, in a warewashing chemical dispenser.

2. Background Art

In the present situation, a detergent dissolving nozzle in conventional detergent dissolving systems is configured in a manner shown in FIGS. 9 and 10 to be a so-called "stationary nozzle spraying system" (referred below to as "stationary nozzle spraying system"), and an angle of injection and a quantity of injection are selected according to water pressure, water temperature, qualities of a detergent or the like. In the case where a detergent dissolving nozzle A of the stationary nozzle spraying system is used to dissolve a solid detergent 16 in a detergent container 15, a cartridge (detergent container) 15 with the solid detergent 16 packed and received therein is turned upside down as shown in FIGS. 9 and 10, hot water or water is sprayed S in a state of being blown up from the detergent dissolving nozzle A, and a detergent solution is conducted to a washing tank 10 through a guide hose 14. Also, the detergent solution 16*a* in the tank 10 is appropriately controlled in concentration by a concentration sensor 9 and an electronic circuit of a detergent feed control circuit board 24 (see FIG. 1).

Also, JP-A-2005-46309 discloses a warewashing chemical dispenser provided with a conventional detergent dissloving system. Further, JP-A-9-131295 discloses a conventional rotary nozzle for washing of dishes.

Subsequently, problems involved in the prior art will be described below.

(1) With the conventional "stationary nozzle spraying system", even when a detergent dissolving nozzle configured in conformity to the environmental condition is selected to dissolve a solid detergent, it is impossible to perform spraying on a dissolved surface of the solid detergent with uniform forces. As a result, a problem arises in that as the solid detergent dissolves, the dissolved surface is varied in level and the solid detergent dissolves in a state, in which it remains partially in the container as shown in FIGS. 10 and 14.

(2) Also, with the detergent dissolving nozzle A of the conventional "stationary nozzle spraying system", water (hot water) is sprayed S from one point in an inverted-cone manner as shown in FIG. 9 and 10, so that it is impossible to equally distribute spraying forces over a central part and a circumferential surface of the solid detergent. As a result, a problem arises in that a state of unsymmetrical wear is resulted since a spray liquid continues to constantly strike against the solid detergent in the same position and in a state free of strong or weak changes.

(3) Further, with the dish washer (see FIGS. 1), in the case where concentration in the washing tank 10 is measured by the concentration sensor 9 and dissolution of a detergent is controlled, dissolution cannot be made to increase the concentration to a set value when dissolution of the solid detergent is continued in a state shown in FIGS. 9 and 10, and the washer judges that a detergent is gone. As a result, a problem occurs that a detergent container is disposed of in a state, in which a considerable amount of the solid detergent remains at a bottom of the detergent container, thus being at a disadvantage in container recycling, or the like.

(4) Also, in the conventional "stationary nozzle spraying system", a solid detergent having lost adhesion to an inner surface of the detergent container can in some cases drop in the form of fragments, and when the solid detergent in the form of fragments flows into a washing tank, a solution in the tank is abnormally increased in concentration with the result that a problem occurs that "rinsing" of articles, dishes, etc., being washed becomes insufficient to have also influences on a human body.

(5) In the case where a detergent in the form of "icicle" shown in FIG. 10 collapses in a solid state and flows into a guide hose, it causes a clogged state at a bent part of the guide hose and a solution accumulates in a server (container receiving part) to spill outside. Thus a problem exists in that the solution thus spilling is strong alkali to deteriorate an environment in a kitchen and adversely affect a human body.

(6) Also, in the case where a clogged state is caused at a bent part of the guide hose, a washing detergent is decreased in concentration to result in failure of washing. As a result, it causes a problem in sanitary supervision.

SUMMARY OF THE INVENTION

It is an object of the invention to provide a rotary nozzle that can dissolve a solid detergent packed in a detergent container in a manner to perform efficient dissolution while forming a dissolved surface horizontally in a dissolving process and to perform dissolution in a final stage without leaving any detergent in the container, and a detergent dissolving system using the rotary nozzle.

A rotary nozzle according to the invention of claim 1 is a rotary nozzle of a closed structure, in which an upper end of a rotary-nozzle fixture is mounted rotatably about a longitudinal direction of a rotary-nozzle body, wherein the rotary-nozzle body is divided vertically into two parts, that is, a rotary-nozzle upper part and a rotary-nozzle lower part, which comprise a central straight part and inclined parts formed in parallel to each other on both longitudinal ends of the straight part to be substantially S-shaped in plan view, the rotary-nozzle lower part is provided with a rotating-shaft hole, which is disposed centrally in a longitudinal direction of the straight part, formed on a top thereof with a circular groove concentric with the rotating-shaft hole, and provided on a back surface thereof with a nozzle bearing part, to which an upper end of the feed nozzle is mounted to be able to swing and which is concentric with the rotating-shaft hole, and wherein a plurality of first liquid reservoir parts disposed predetermined distances offset from the rotating-shaft hole on both sides in the longitudinal direction are arranged on the rotary-nozzle upper part, the first liquid reservoir parts being provided along central axes thereof with injection holes, which are arranged in parallel to one another to be able to perform vertical and sectorial injection in a straight manner in a state, in which injection is not interfered by one another, second liquid reservoir parts are arranged on both ends in the longitudinal direction and provided with horizontal injection holes in a direction of rotation, which perform injection substantially horizontally to act as a rotational power, and a passage is provided between the second liquid reservoir parts arranged on the both ends to be communicated to the first liquid reservoir parts and the second liquid reservoir parts, and wherein the rotary-nozzle fixture is formed to have a diameter to afford insertion into a hole of the feed nozzle mounted to the feed part and provided at an upper end thereof with a flange, which can be inserted rotatably into the circular groove.

A rotary nozzle according to the invention of claim 2 adds to the rotary nozzle according to claim 1 a feature in which an O-ring insertion groove is provided on a back surface of the rotary-nozzle upper part along the passage, a ridge is correspondingly provided on an upper surface of the rotary-nozzle lower part, an engaging piece is arranged on an outer periphery of a side of the rotary-nozzle upper part, a latch pawl is correspondingly arranged on an outer periphery of a side of the rotary-nozzle lower part, and the rotary-nozzle upper part is mounted on the rotary-nozzle lower part through an O-ring in a closed construction.

A rotary nozzle according to the invention of claim 3 adds to the rotary nozzle according to claim 1 a feature in which the first liquid reservoir parts and the second liquid reservoir parts are formed to be domed.

A detergent dissolving system according to the invention of claim 4 comprises a feed nozzle of a container receiving part, in which a vertical feed part connected to a hot water inlet pipe and a solution outlet are arranged on a lower end thereof and the feed nozzle with a hole is screwed into an upper end of the feed part, and a rotary nozzle of a closed structure, in which an upper end of a rotary-nozzle fixture is mounted rotatably about a longitudinal direction of a rotary-nozzle body, and the rotary-nozzle body is divided vertically into two parts, that is, a rotary-nozzle upper part and a rotary-nozzle lower part, which comprise a central straight part and inclined parts formed in parallel to each other on both longitudinal ends of the straight part to be substantially S-shaped in plan view, the rotary-nozzle lower part being provided with a rotating-shaft hole, which is disposed centrally in a longitudinal direction of the straight part, formed on a top thereof with a circular groove concentric with the rotating-shaft hole, and provided on a back surface thereof with a nozzle bearing part, to which an upper end of the feed nozzle is mounted to be able to swing and which is concentric with the rotating-shaft hole, a plurality of first liquid reservoir parts disposed predetermined distances offset from the rotating-shaft hole on both sides in the longitudinal direction are arranged on the rotary-nozzle upper part, the first liquid reservoir parts being provided along central axes thereof with injection holes, which are arranged in parallel to one another to be able to perform vertical and sectorial injection in a straight manner in a state, in which injection is not interfered by one another, second liquid reservoir parts being arranged on both ends in the longitudinal direction and provided with horizontal injection holes, which perform injection substantially horizontally toward the second liquid reservoir parts to act as a rotational power, a passage being provided between the second liquid reservoir parts arranged on the both ends to be communicated to the first liquid reservoir parts and the second liquid reservoir parts, and the rotary-nozzle fixture is formed to have a diameter to afford insertion into a hole of the feed nozzle mounted to the feed part and provided at an upper end thereof with a flange, which can be inserted rotatably into the circular groove, the rotary-nozzle fixture being inserted into the hole of the feed nozzle, a nozzle bearing part being mounted to the upper end of the feed nozzle to be able to swing, and feed water fed to the passage being injected from the injection holes vertically, sectorially, and further straight and simultaneously injected from the horizontal injection holes to rotate the rotary nozzle horizontally to dissolve a solid detergent.

EMBODIMENTS

An embodiment of the invention will be described with reference to FIGS. 1 to 8, 11, and 12 to 13.

Figure 1:
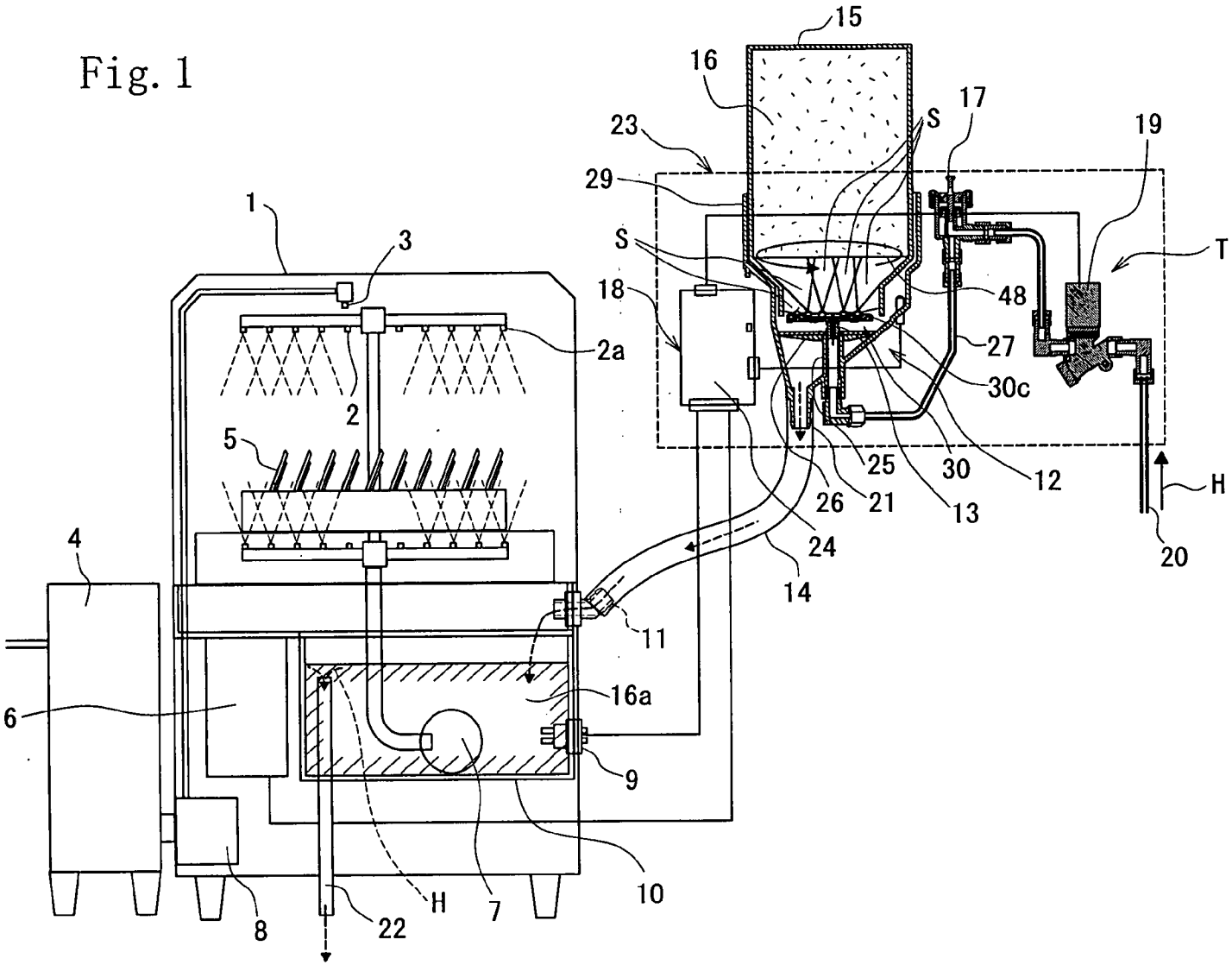
FIG. 1 is a view illustrating a whole construction of an automatic dish washer 1 according to the invention.
Figure 2:
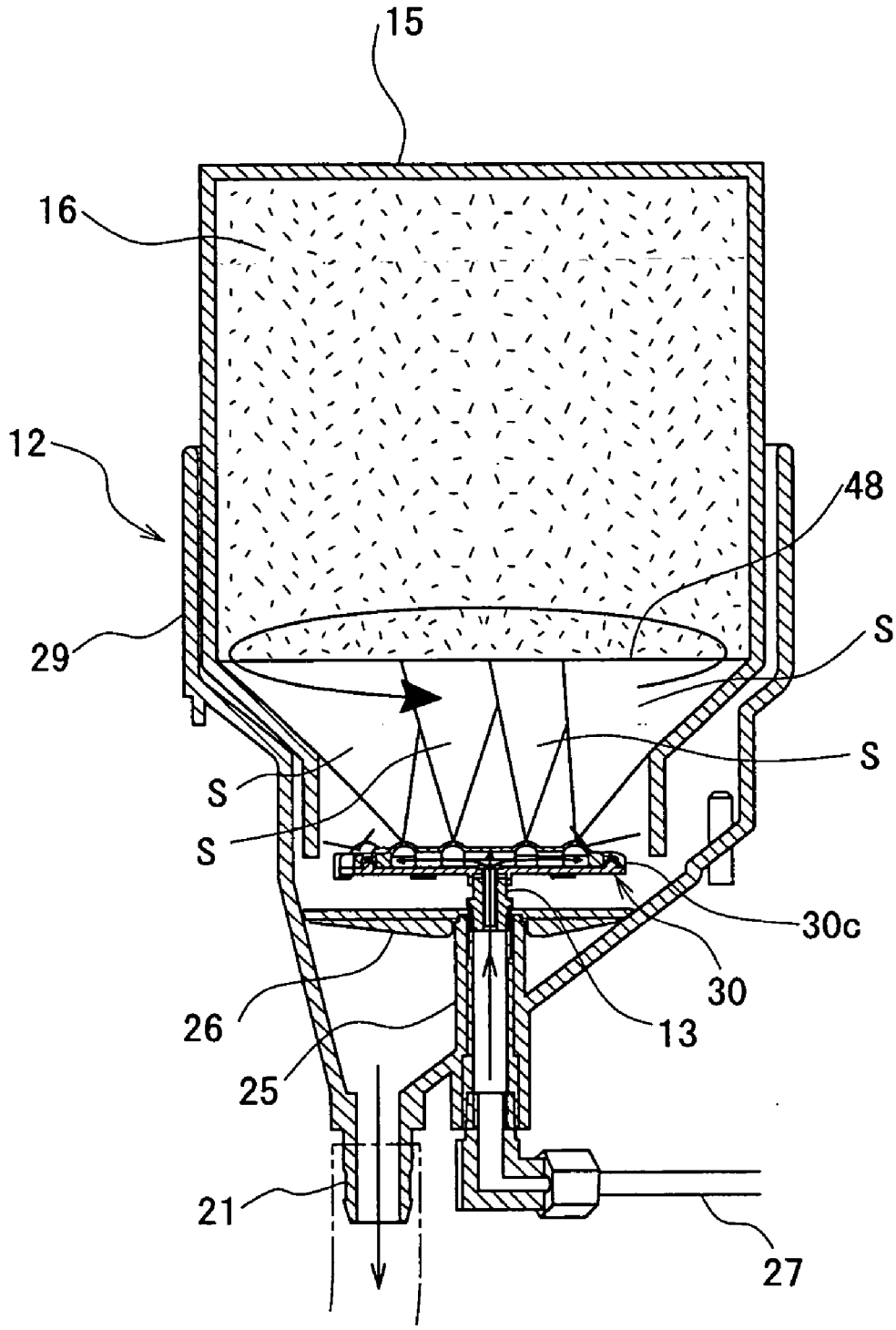
FIG. 2 is a partially, cross sectional view showing a solid detergent at the time of initial dissolution in the invention.
Figure 3:
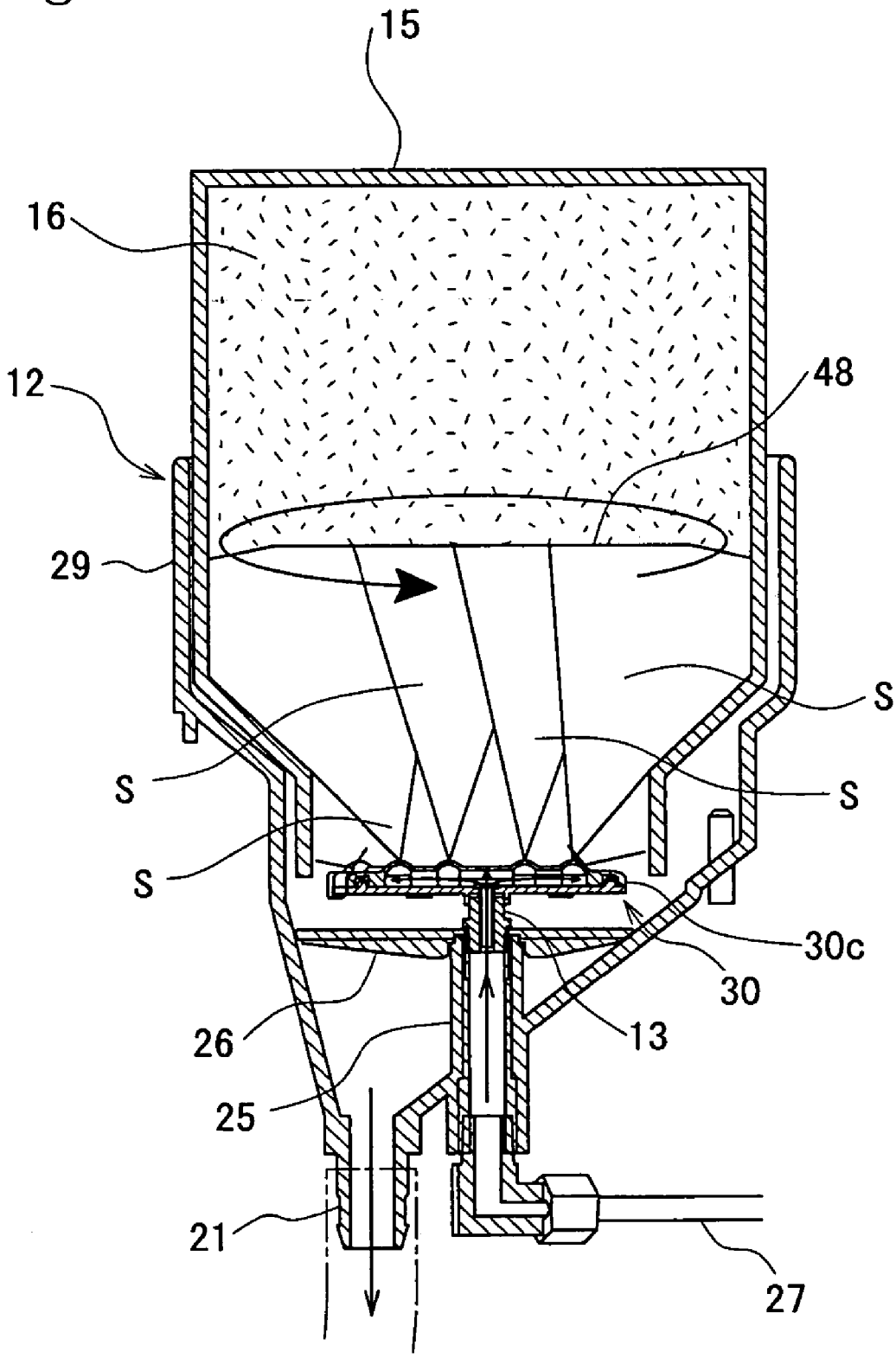
FIG. 3 is a partially, cross sectional view showing a solid detergent at the time of middle dissolution in the invention.

In FIG. 1, in an initial operation of an automatic dish washer 1 according to the invention, hot water from a water heater 4 is first injected through a rinsing nozzle 3 into a washing tank 10 to store a suitable amount of hot water therein. At this time, a signal power supply from a washer control unit 6 operates a detergent feed control system 18 and concentration in the washing tank 10 is measured by a concentration sensor 9. A hot water control solenoid valve 19 is opened to exercise control until a detergent concentration reaches a preset concentration.

On the other hand, hot water H fed from a hot water inlet pipe 20 is caused to pass through a feed nozzle 13 in a detergent dissolving system 12 by way of a vacuum breaker 17 to be injected in a sprayed manner by a rotary nozzle 30 to dissolve a solid detergent 16 in a detergent container 15, and the dissolve detergent is poured into the washing tank 10 by way of a guide hose 14, which connects between a detergent solution inlet 11 and a solution outlet 21, from the solution outlet 21 and replenished. Such operation for replenishment is repeatedly performed until the detergent concentration in the washing tank 10 reaches a set concentration.

Subsequently, a detergent solution 16*a* stored in the washing tank 10 is fed to a group 2 of washing nozzles by a detergent circulating pump 7 and injected from nozzles 2*a* of the group 2 of washing nozzles to wash dishes 5. The hot water H used for washing is freed of soiled things by a net (illustration of which is omitted) to be returned to the washing tank 10.

Further, the hot water H in the water heater 4 is fed by a rinsing pump 8 and injected from the rinsing nozzle 3 to rinse the dishes 5. The hot water used for rinsing is returned to the washing tank 10 and the hot water increased at this time is drained from a drain pipe 22.

In the washing tank 10, the concentration sensor 9 detects detergent concentration decreased by drainage of the increased hot water H by way of the drain pipe 22 and use of the increased hot water for washing of the dishes 5, and the dissolved detergent is replenished. This operation is repeatedly performed.

A warewashing chemical dispenser 23 in FIG. 1 receives therein a necessary equipment such as pipe, wiring, etc., which constitute the warewashing chemical dispenser 23, in a compact manner.

The detergent dissolving system 12, which constitutes the warewashing chemical dispenser 23, comprises a feed part 25 arranged substantially centrally in a container receiving part 29, and a solution outlet 21 arranged offset from a center of the container receiving part 29.

Also, a receiving part T in the vicinity of the container receiving part 29 in the warewashing chemical dispenser 23 receives therein the hot water control solenoid valve 19, the vacuum breaker 17, and a detergent feed control circuit board 24 provided with a display, a buzzer, etc.

In addition, the reference numeral 26 denotes a bearing board that prevents dust and a dropping article from flowing into the washing tank 10 from the solution outlet 21.

A schematic construction of the automatic dish washer 1 is described above, and the invention relates to the detergent dissolving system 12 in the automatic dish washer 1.

First, the rotary nozzle 30, according to claim 1, used for the detergent dissolving system 12 will be described with reference to FIGS. 2 to 8 and 11.

The rotary nozzle 30 is of a closed structure, in which an upper end of a rotary-nozzle fixture 42 is mounted rotatably about a longitudinal direction of a rotary-nozzle body 30*c*.

The rotary-nozzle body 30*c* is divided vertically into two parts, that is, a rotary-nozzle upper part 31 and a rotary-nozzle lower part 36, the parts comprising a central straight-part 30*a* and inclined parts 30*b* formed in parallel to each other on both longitudinal ends of the straight part to be substantially S-shaped in plan view.

Also, the rotary-nozzle lower part 36 is provided with a rotating-shaft hole 41*a*, which is disposed centrally in a longitudinal direction of the straight part 30*a*. Also, formed on a top of the rotary-nozzle lower part 36 is a circular groove 44 concentric with the rotating-shaft hole 41*a*, and provided on a back surface of the rotary-nozzle lower part is a nozzle bearing part 41, to which an upper end of the feed nozzle 13 is mounted to be able to swing and which is concentric with the rotating-shaft hole 41*a*.

Also, arranged on the rotary-nozzle upper part 31, which constitutes the rotary-nozzle body 30*c*, are a plurality of first liquid reservoir parts 32 disposed predetermined distances offset from the rotating-shaft hole 41*a* on both sides in the longitudinal direction. Also, injection holes 33 arranged in parallel to one another are provided, in the first liquid reservoir parts 32, along a central axis of the rotary-nozzle upper part 31 in a lengthwise slit manner to be able to perform vertical and sectorial injection in a straight manner in a state, in which injection is not interfered by one another.

Also, second liquid reservoir parts 34 are arranged on both ends of the rotary-nozzle upper part 31 in the longitudinal direction, and-horizontal injection holes 35 are provided in a direction of rotation to inject in an almost horizontal manner and to act as a rotational power for the rotary-nozzle body 30*c* in the second liquid reservoir parts 34.

Further, a passage 39 is provided between the second liquid reservoir parts 34 arranged on both ends of the rotary-nozzle upper part 31 to be communicated to the first liquid reservoir parts 32 and the second liquid reservoir parts 34.

Figure 5:
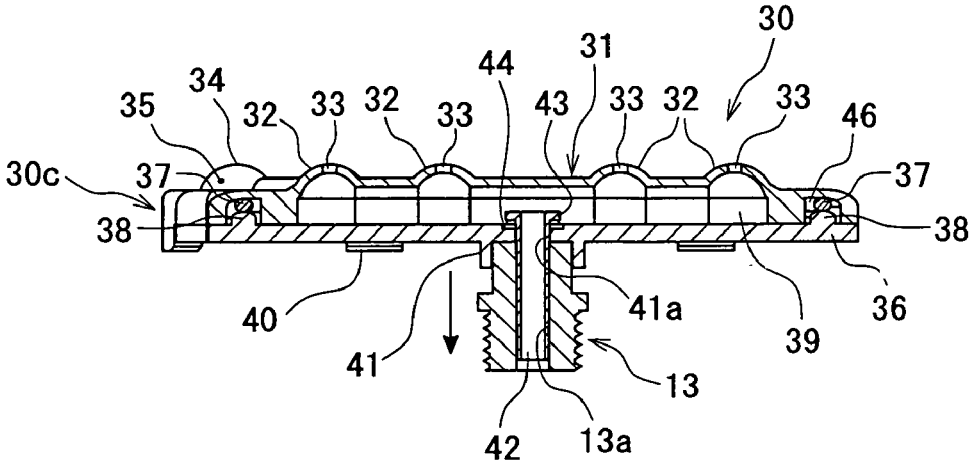
FIG. 5 is a cross sectional view showing the rotary nozzle and a feed nozzle at the time of stopping the flow of water in the invention.

The rotary-nozzle fixture 42 is formed to have a diameter to afford insertion into a hole 13*a* of the feed nozzle 13 mounted to the feed part 25, and a flange 43, which can be inserted rotatably into the circular groove 44, is provided at an upper end of the rotary-nozzle fixture 42 (see FIG. 5).

Figure 11:
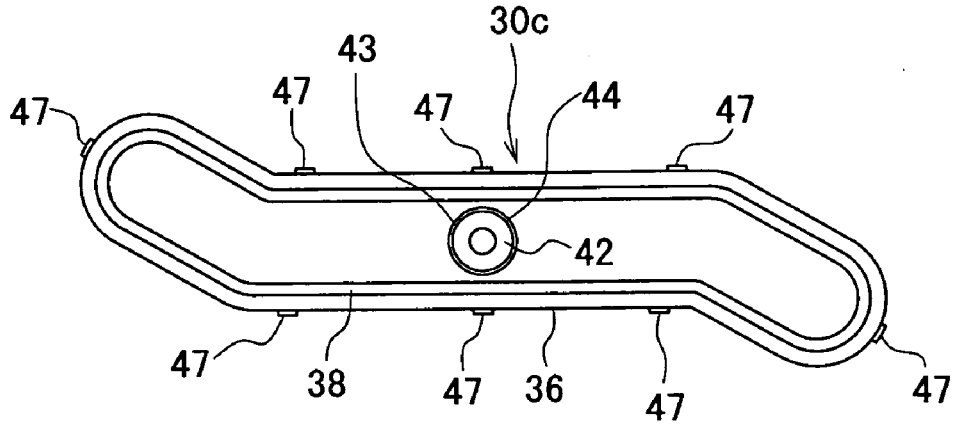
FIG. 11 is an exploded view showing the rotary nozzle in the invention.
Figure 11:
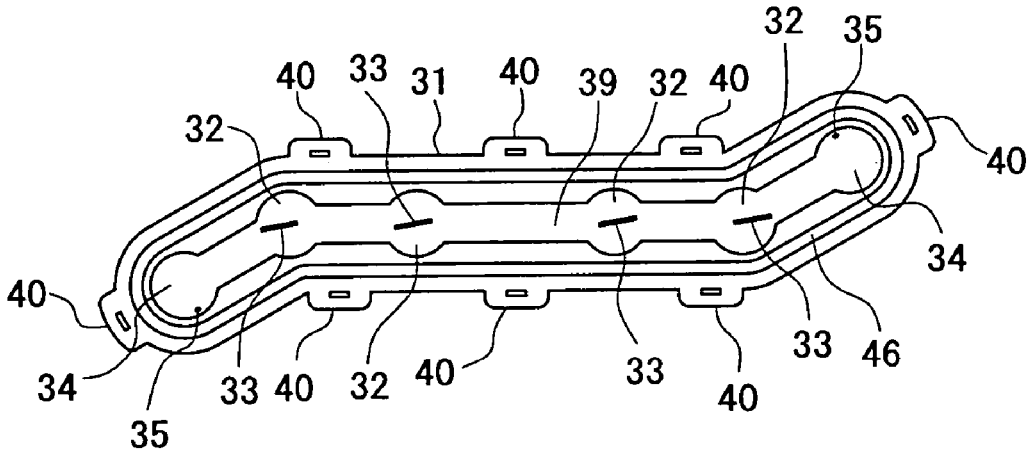

FIG. 11 is related to the invention according to claim 2, an O-ring insertion groove 46 is provided along a passage 39 on a back surface of a rotary-nozzle upper part 31, and a ridge 38 is correspondingly provided on an upper surface of a rotary-nozzle lower part 36.

Also, engaging pieces 40 are arranged on an outer periphery of a side of the rotary-nozzle upper part 31, and latch pawls 47 are correspondingly arranged on an outer periphery of a side of the rotary-nozzle lower part 36. A closed construction is assembled by closing the rotary-nozzle upper part 31 on the rotary-nozzle lower part 36 via an O-ring 37 and-fitting the engaging pieces 40 tightly onto the latch pawls 47.

Figure 4:
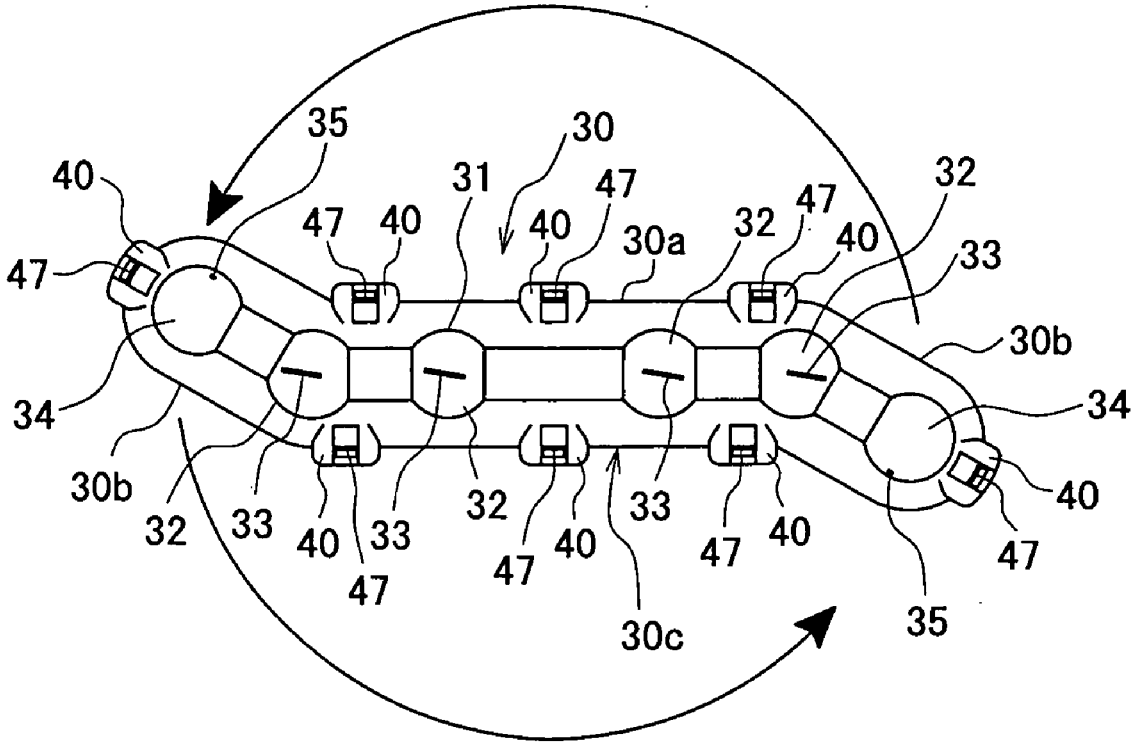
FIG. 4 is a plan view showing a rotary nozzle in the invention.
Figure 6:
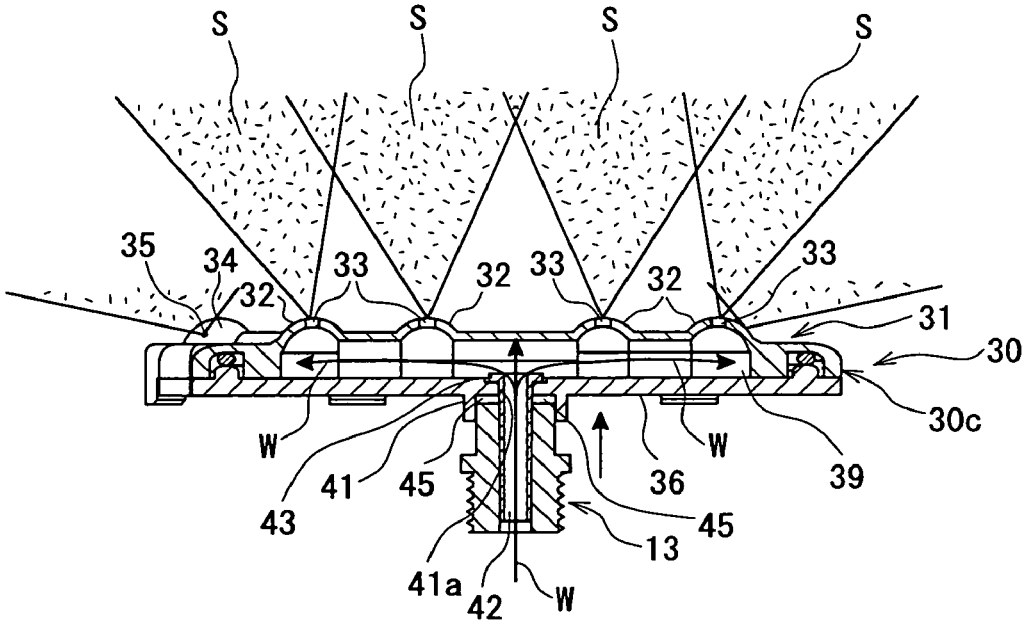
FIG. 6 is a cross sectional view showing the rotary nozzle and the feed nozzle at the time of spraying in the invention.
Figure 7:
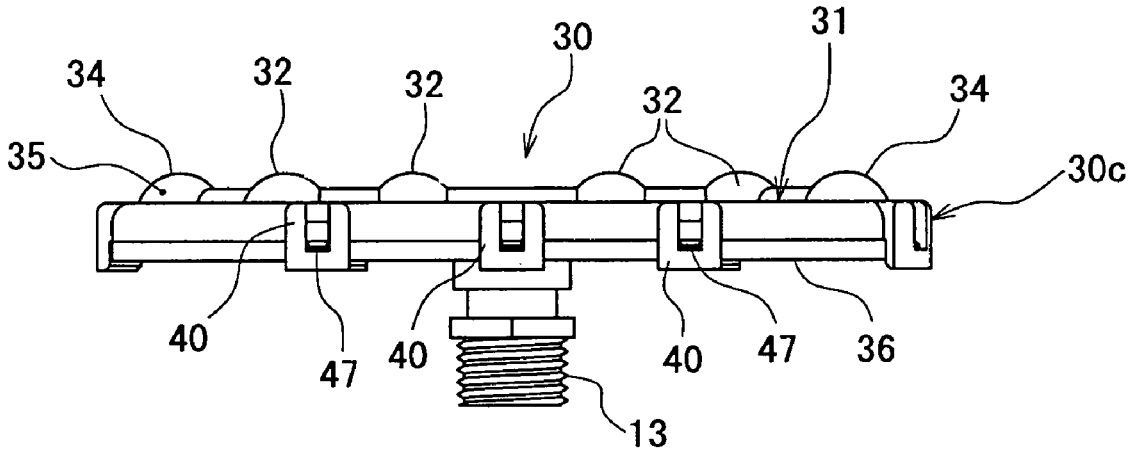
FIG. 7 is a front view showing the rotary nozzle and the feed nozzle in an assembled state in the invention.
Figure 8:
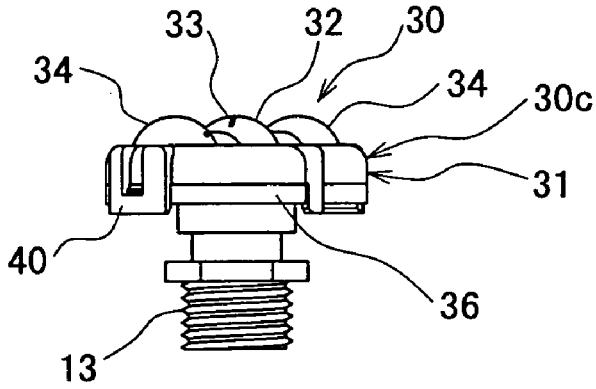
FIG. 8 is a right side view showing the rotary nozzle and the feed nozzle in an assembled state in the invention.
Figure 9:
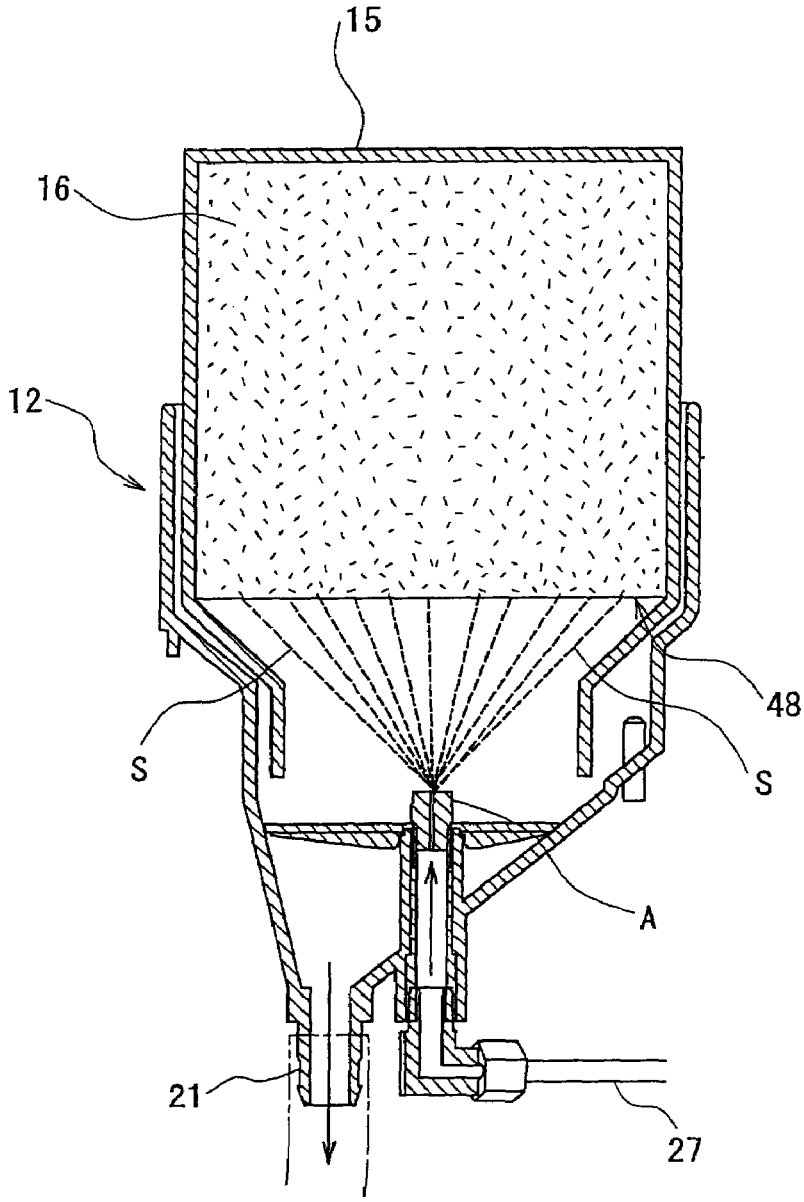
FIG. 9 is a partially, cross sectional view showing a conventional detergent dissolving system at the time of initial dissolution.

According to the invention of claim 3, the first liquid reservoir parts 32 and the second liquid reservoir parts 34 on the rotary-nozzle upper part 31 are preferably formed to be domed or arcuate in cross section as shown in FIGS. 4 to 6 so that feed water W fed to the passage 39 can be injected vertically and sectorially.

Subsequently, the detergent dissolving system 12 according to the invention of claim 4 will be described with reference to FIGS. 1 to 8.

As described above, in the detergent dissolving system 12, the rotary-nozzle fixture 42 of the rotary nozzle according to claim 1 is inserted into the hole 13*a* of the feed nozzle 13 of the container receiving part 29, in which the vertical feed part 25 connected to a hot water inlet pipe 27 and the solution outlet 21 are arranged on a lower end of the container receiving part 29, which receives therein the detergent container 15 packed with the solid detergent 16, and the feed nozzle 13 having the hole 13*a* is screwed into an upper end of the feed part 25, and a nozzle bearing part 41 is mounted to the upper end of the feed nozzle 13 to be able to swing.

The solid detergent is dissolved by injecting feed water W, which is fed to the passage 39, vertically, sectorially, and further straight from the injection holes 33, and simultaneously rotating the rotary nozzle 30 horizontally with injection from the horizontal injection holes 35.

In addition, since the rotary nozzle 30 is the same in structure as the rotary nozzle 30 according to claim 1, an explanation therefor is omitted.

According to the invention constructed in the above manner, after a lower end of the feed nozzle 13 is inserted into the feed part 25, the rotary-nozzle fixture 42 of the rotary nozzle 30 is inserted into the hole 13*a* of the feed nozzle 13 and the nozzle bearing part 41 is mounted and fixed to the upper end of the feed nozzle 13 to be able to swing (see FIGS. 2 to 5).

When the detergent dissolving system 12 stops (stops the flow of water), the rotary-nozzle lower part 36 of the rotary-nozzle body 30*c* descends downward to contact with the upper end of the feed nozzle 13 (see FIG. 5). Also, when hot water is fed from the hot water inlet pipe 27, water pressure is applied centrally inside to push up the whole rotary nozzle 30 a slight height in a state of floating a little to start spraying S from the injection holes 33 vertically, sectorially, and further straight in a state, in which spraying from the injection holes does not interfere with one another, and simultaneously the rotary-nozzle body 30*c* automatically starts rotation with injection of water from the horizontal injection holes 35 as power. At this time, a clearance 45 is produced between the upper end of the feed nozzle 13 and the rotary-nozzle lower part 36 (see FIG. 6), and inside water comes out to act to reduce resistance, so that the rotary-nozzle body 30*c* gets a sufficient torque even at low water pressure to rotate.

When feed water W is started to be fed to the passage 39, it is injected from the injection holes 33 vertically, sectorially, and further straight and simultaneously jetted from the horizontal injection holes 35 horizontally to rotate the rotary-nozzle body 30*c* at a predetermined speed according to water pressure. Water pressure sprayed sectorially and straight strikes uniformly against a dissolved surface of the solid detergent to dissolve the same in a planar manner. At this time, since the rotary-nozzle body 30*c* continuously rotates in a state of sectorial spraying, it always changes a dissolved state of the dissolved surface. Such dissolution is repeatedly performed whereby the dissolved state of the dissolved surface is averaged and the dissolved surface is formed to be planar.

Figure 12:
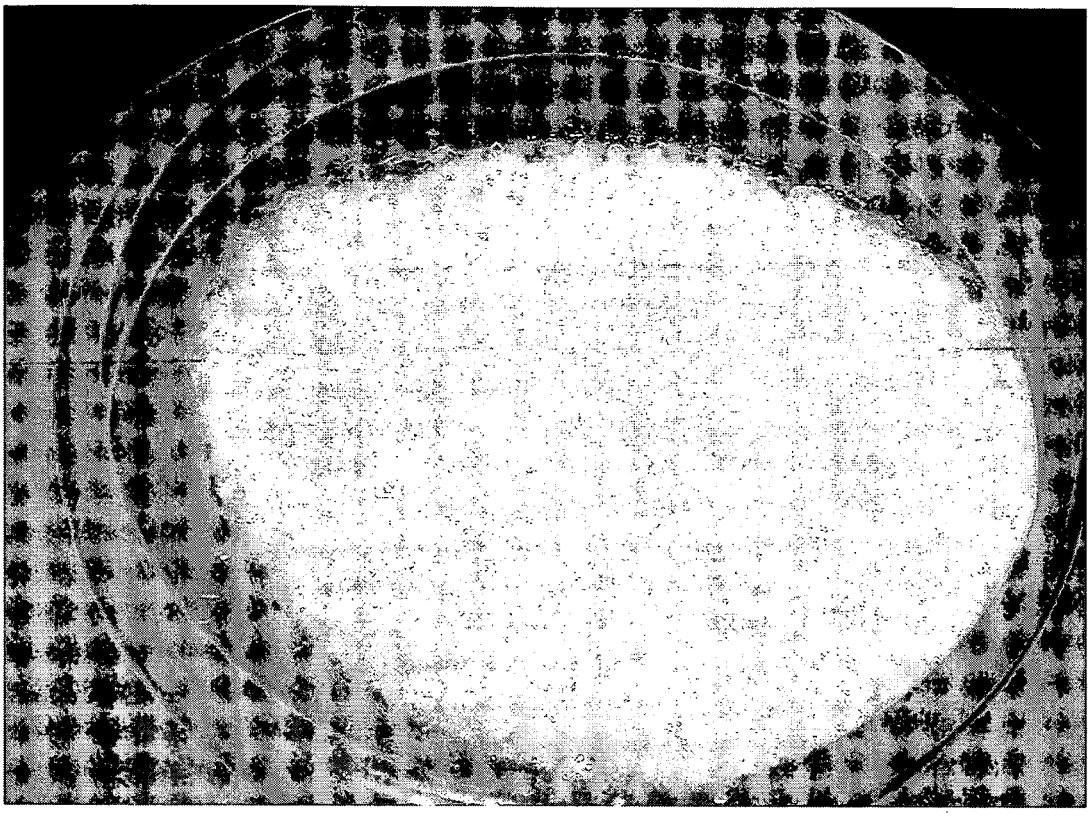
FIG. 12 is a photograph showing a state of dissolution in initial dissolution in use of the rotary nozzle in the invention.
Figure 13:
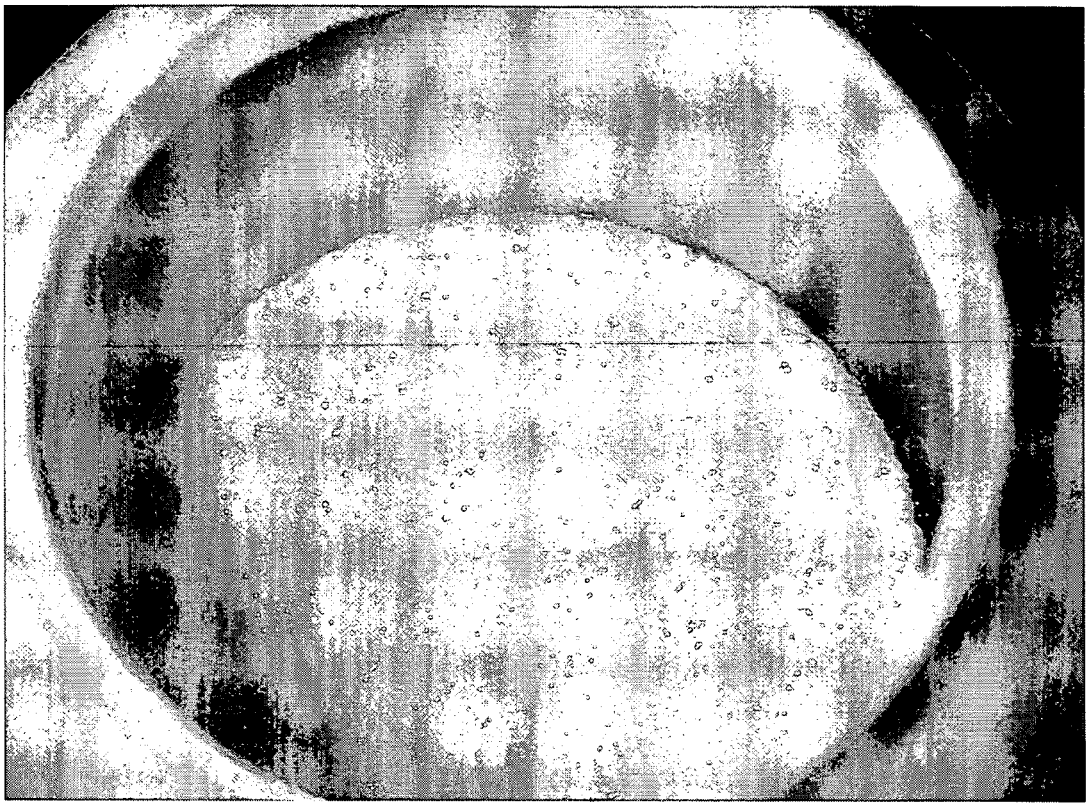
FIG. 13 is a photograph showing a state of-dissolution in middle dissolution in use of the rotary nozzle in the invention.

Thereby, a planar dissolved state can be maintained and the detergent is dissolved in a state of not remaining in the container (see a photograph in FIG. 12 showing a state of dissolution in initial dissolution in use of the rotary nozzle in the invention, and a photograph in FIG. 13 showing a state of dissolution in middle dissolution).

The invention produced the following effects.

(1) Since the rotary-nozzle body continuously rotates in a state of sectorial and straight spraying, it always changes a dissolved state of the dissolved surface. Such dissolution is repeatedly performed whereby the dissolved state of the dissolved surface is averaged and the dissolved surface is formed to be planar. Accordingly, a planar dissolved state of the solid detergent can be maintained to attain an ideal dissolution of the solid detergent, which is performed in a state of the detergent not remaining in the container (see photographs in FIGS. 12 and 13).

Then it is possible to dissolve a solid detergent packed in a detergent container in a manner to perform efficient dissolution while forming a dissolved surface horizontally in a dissolving process and to perform dissolution in a final stage without leaving any detergent in the container.

(2) With the rotary-nozzle body of the invention, it is possible to dissolve a solid detergent in a planar form with no connection to "angle of injection" and "wide angle of injection" and to perform dissolution in a final stage without leaving any detergent in the vicinity of a cartridge inner wall. As a result, a detergent container can be disposed of with no solid detergent remaining in the container, so that it is possible to deploy an advantageous recycling of containers, or the like.

(3) When hot water is fed to the feed nozzle from the feed part, water pressure is applied centrally inside the rotary-nozzle body to push up the whole rotary nozzle to start spraying sectorially from the injection holes for dissolution, and simultaneously water is injected from the horizontal injection holes arranged at both ends, so that the rotary-nozzle body starts to rotate. At this time, a clearance is produced between the upper end of the feed nozzle and the rotary-nozzle lower part, and inside water comes out to act to reduce resistance, so that the rotary-nozzle body gets a sufficient torque even at low water pressure to be able to rotate.

(4) An effect can be produced a lot on the dissolving capacity of a solid detergent by using a feed part in the neighborhood of a conventional detergent dissolving nozzle as it is without reconstruction, exchanging the nozzle for a feed nozzle of the invention, and mounting a rotary nozzle to the feed nozzle.

(5) It is possible to prevent an accident, in which a solid detergent flows into a washing tank as it is in the form of fragments and concentration detected by a concentration sensor is abnormally increased. Also, control of concentration is favorably exercised and "rinsing" of dishes, etc. is adequately performed.

Figure 10:
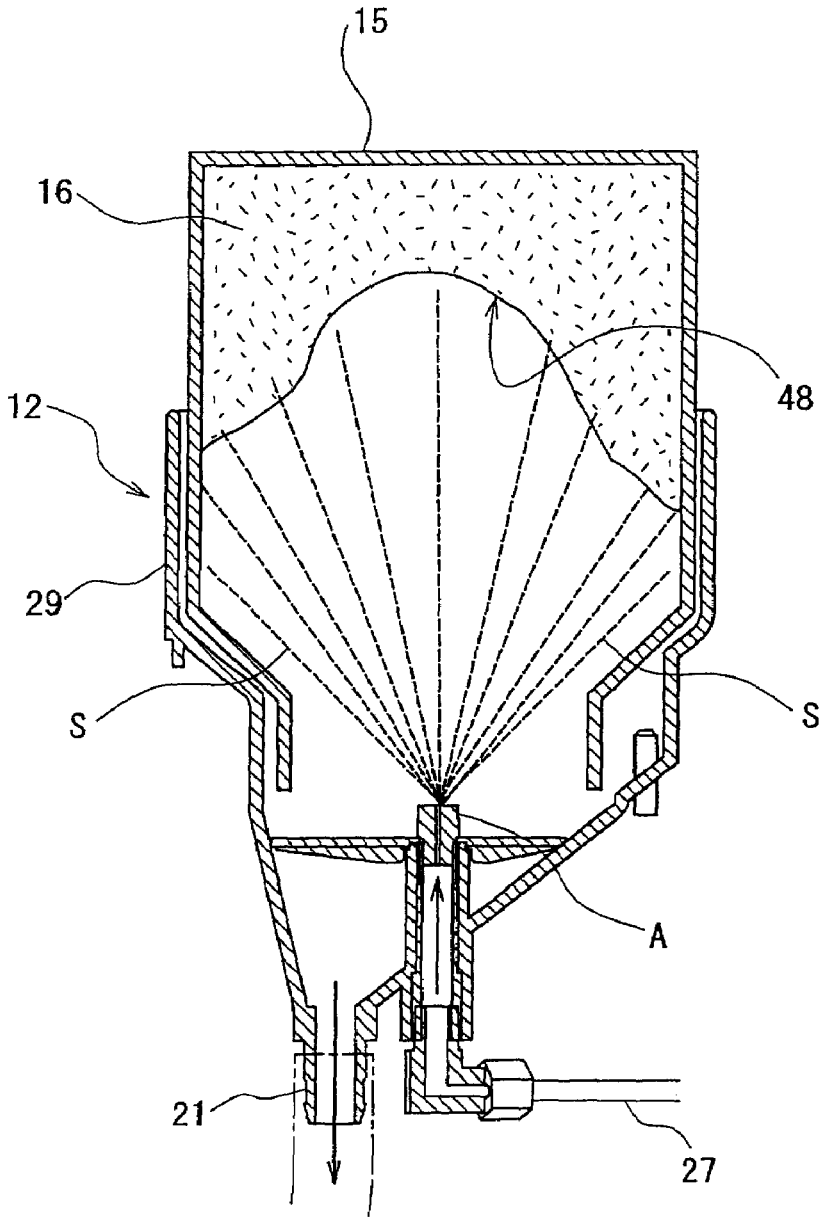
FIG. 10 is a partially, cross sectional view showing the conventional detergent dissolving system at the time of dissolution subsequent to middle dissolution.
Figure 14:
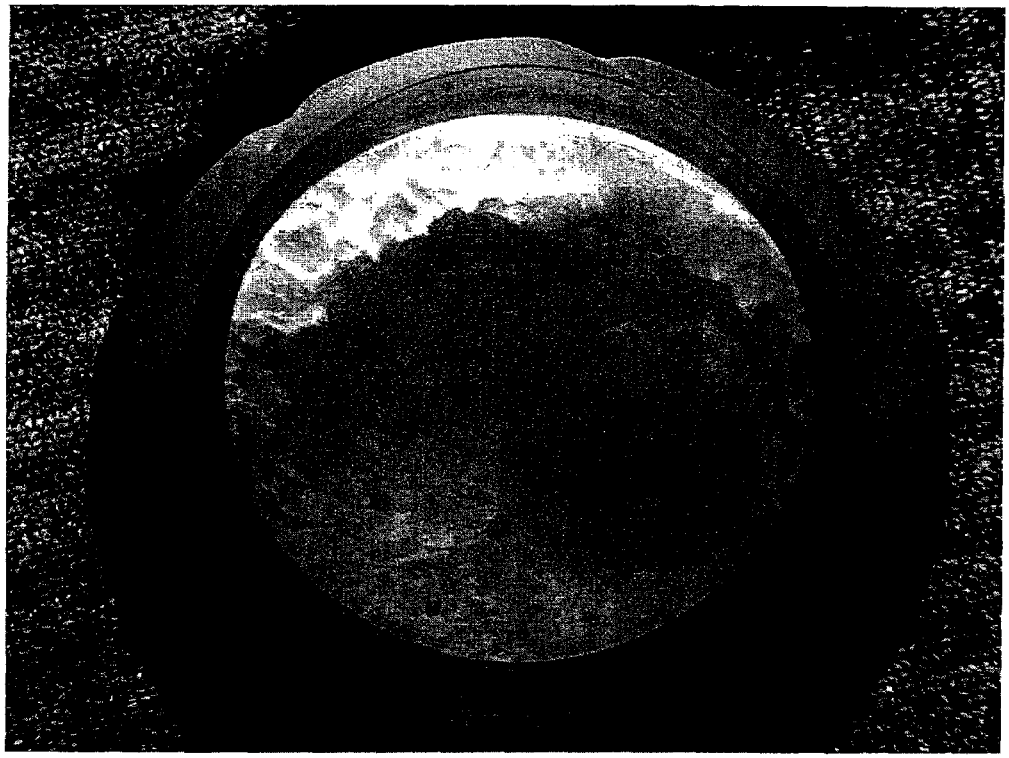
FIG. 14 is a photograph showing a state of dissolution in middle dissolution in use of a conventional rotary nozzle.

(6) It is possible to prevent an accident, in which a solid detergent dissolved in the form of "icicle" (see FIGS. 10 and 14) collapses in a solid state and flows into a guide hose to cause a clogged state at a bent part of the guide hose. Also, since the guide hose causes no clogged state, failure of washing is eliminated and the guide hose can be used safely in terms of sanitary supervision.

What is claimed is:

1. A rotary nozzle of a closed structure, in which an upper end of a rotary-nozzle fixture is mounted rotatably about a longitudinal direction of a rotary-nozzle body, wherein the rotary-nozzle body is divided vertically into two parts, that is, a rotary-nozzle upper part and a rotary-nozzle lower part, which comprise a central straight part and inclined parts formed in parallel to each other on both longitudinal ends of the straight part to be substantially S-shaped in a plan view, the rotary-nozzle lower part is provided with a rotating-shaft hole, which is disposed centrally in a longitudinal direction of the straight part, formed on a top thereof with a circular groove concentric with the rotating-shaft hole, and provided on a back surface thereof with a nozzle bearing part, to which an upper end of the feed nozzle is mounted to be able to swing and which is concentric with the rotating-shaft hole, and wherein a plurality of first liquid reservoir parts disposed predetermined distances offset from the rotating-shaft hole on both sides in the longitudinal direction are arranged on the rotary-nozzle upper part, the first liquid reservoir parts being provided along central axes thereof with injection holes, which are arranged in parallel to one another to be able to perform vertical and sectorial injection in a straight manner in a state, in which injection is not interfered by one another, second liquid reservoir parts are arranged on both ends in the longitudinal direction and provided with horizontal injection holes in a direction of rotation, which perform injection substantially horizontally toward the second liquid reservoir parts to act as a rotational power, and a passage is provided between the second liquid reservoir parts arranged on the both ends to be communicated to the first liquid reservoir parts and the second liquid reservoir parts, and wherein the rotary-nozzle fixture is formed to have a diameter to afford insertion into a hole of the feed nozzle mounted to the feed part and provided at an upper end thereof with a flange, which can be inserted rotatably into the circular groove.

2. The rotary nozzle according to claim 1, wherein an O-ring insertion groove is provided on a back surface of the rotary-nozzle upper part along the passage, a ridge is correspondingly provided on an upper surface of the rotary-nozzle lower part, an engaging piece is arranged on an outer periphery of a side of the rotary-nozzle upper part, a latch pawl is correspondingly arranged on an outer periphery of a side of the rotary-nozzle lower part, and the rotary-nozzle upper part is mounted on the rotary-nozzle lower part through an O-ring in a closed construction.

3. The rotary nozzle according to claim 1, wherein the first liquid reservoir parts and the second liquid reservoir parts are formed to be domed.

4. A detergent dissolving system comprising a feed nozzle of a container receiving part, in which a vertical feed part connected to a hot water inlet pipe and a solution outlet are arranged on a lower end thereof and the feed nozzle with a hole is screwed into an upper end of the feed part, and a rotary nozzle of a closed structure, in which an upper end of a rotary-nozzle fixture is mounted rotatably about a longitudinal direction of a rotary-nozzle body, wherein the rotary-nozzle body is divided vertically into two parts, that is, a rotary-nozzle upper part and a rotary-nozzle lower part, which comprise a central straight part and inclined parts formed in parallel to each other on both longitudinal ends of the straight part to be substantially S-shaped in a plan view, the rotary-nozzle lower part is provided with a rotating-shaft hole, which is disposed centrally in a longitudinal direction of the straight part, formed on a top thereof with a circular groove concentric with the rotating-shaft hole, and provided on a back surface thereof with a nozzle bearing part, to which an upper end of the feed nozzle is mounted to be able to swing and which is concentric with the rotating-shaft hole, and wherein a plurality of first liquid reservoir parts disposed predetermined distances offset from the rotating-shaft hole on both sides in the longitudinal direction are arranged on the rotary-nozzle upper part, the first liquid reservoir parts being provided along central axes thereof with injection holes, which are arranged in parallel to one another to be able to perform vertical and sectorial injection in a straight manner in a state, in which injection is not interfered by one another, second liquid reservoir parts are arranged on both ends in the longitudinal direction and provided with horizontal injection holes in a direction of rotation, which perform injection substantially horizontally toward the second liquid reservoir parts to act as a rotational power, and a passage is provided between the second liquid reservoir parts arranged on the both ends to be communicated to the first liquid reservoir parts and the second liquid reservoir parts, and wherein the rotary-nozzle fixture is formed to have a diameter to afford insertion into a hole of the feed nozzle mounted to the feed part and provided at an upper end thereof with a flange, which can be inserted rotatably into the circular groove, the rotary-nozzle fixture is inserted into the hole of the feed nozzle, and a nozzle bearing part is mounted to the upper end of the feed nozzle to be able to swing, and wherein feed water fed to the passage is injected from the injection holes vertically, sectorially, and further straight and simultaneously injected from the horizontal injection holes to rotate the rotary nozzle horizontally to dissolve a solid detergent.

* * * * *